US006720857B2

(12) United States Patent
Borchardt et al.

(10) Patent No.: US 6,720,857 B2
(45) Date of Patent: Apr. 13, 2004

(54) HIGH VOLTAGE FUSE

(75) Inventors: Glenn R. Borchardt, Round Lake Beach, IL (US); Jorge R. Montante, Cicero, IL (US); Martin A. Warszawa, Arlington Heights, IL (US)

(73) Assignee: S&C Electric Co., Chicago, IL (US)

( * ) Notice: Subject to any disclaimer, the term of this patent is extended or adjusted under 35 U.S.C. 154(b) by 0 days.

(21) Appl. No.: 10/368,215

(22) Filed: Feb. 18, 2003

(65) Prior Publication Data

US 2003/0179069 A1 Sep. 25, 2003

Related U.S. Application Data

(60) Provisional application No. 60/361,601, filed on Mar. 2, 2002.

(51) Int. Cl.[7] ..... H01H 85/30; H01H 85/02

(52) U.S. Cl. ..... 337/244; 337/206; 337/265; 439/490

(58) Field of Search ..... 337/206, 241, 337/242, 245, 266; 439/490, 491, 622; 324/507, 550, 691; 340/638, 69; 361/835; 81/3.8

(56) References Cited

U.S. PATENT DOCUMENTS 3,593,249 A * 7/1971 Sedgwick ..... 337/113
3,657,679 A * 4/1972 Wilson ..... 337/244
3,678,430 A * 7/1972 Gaia ..... 337/159
4,058,784 A * 11/1977 Gaia ..... 337/164
4,060,786 A * 11/1977 Cuzzone ..... 337/244
4,114,128 A * 9/1978 Cameron ..... 337/162
4,204,182 A * 5/1980 Knapp, Jr. ..... 337/244
4,296,397 A * 10/1981 Sedberry ..... 337/199
4,317,099 A * 2/1982 Sabis ..... 337/170
4,344,059 A * 8/1982 Swanson ..... 337/174
4,593,262 A * 6/1986 Krueger ..... 337/163
4,617,544 A * 10/1986 Mooz et al. ..... 337/3
5,502,427 A * 3/1996 Scherer et al. ..... 337/176
5,760,673 A * 6/1998 Hassler et al. ..... 337/168
6,256,183 B1 * 7/2001 Mosesian ..... 361/104

FOREIGN PATENT DOCUMENTS

JP 63269433 A * 11/1988 ..... H01H/85/00

* cited by examiner

*Primary Examiner*—Anatoly Vortman
(74) *Attorney, Agent, or Firm*—James V. Lapacek

(57) ABSTRACT

A fuse is provided that is suitable for operation in unusual environments and includes an operation indicator that is simple and reliable. A movable arcing tube is released during operation. As the arcing tube moves outside the fuse assembly, a latching spring moves into a receiving groove in the arcing tube to retain the arcing tube in the external operated position.

7 Claims, 2 Drawing Sheets

HIGH VOLTAGE FUSE

This application claims the benefit of U.S. Provisional Application No. 60/361,601 filed on Mar. 2, 2002 in the names of G. R. Borchardt et al.

BACKGROUND OF THE INVENTION

1. Field of the Invention

The present invention relates generally to high voltage fuses and more particularly to a fuse suitable for operation in unusual environments and including an operation indicator.

2. Description of the Related Art

Various types of high voltage fuses are known having diverse construction. The fuse shown in U.S. Pat. No. 5,502,427 includes a fuse cartridge coupled to a spring assembly positioned within a fuse tube. The fuse shown in U.S. Pat. No. 4,344,059 includes an arcing rod moving within a conductive fuse tube with the arcing rod being engaged by a catcher when the arcing rod moves during fuse operation so that the arcing rod will not bounce back or reverse direction during and after fuse operation. The catcher includes angled fingers that interact to capture a flange carried by the arcing rod. U.S. Pat. No. 4,058,784 illustrates an indicator-equipped fuse where the indicator that moves outside the casing of the fuse. The fuse in U.S. Pat. No. 4,296,397 is suited for a corrosive atmosphere so as to maintain a non-conductive path after operation.

While the fusible elements of the prior art may be generally suitable for their intended uses, they do not provide a compact fuse for use in unusual environments and including an operation indicator.

SUMMARY OF THE INVENTION

Accordingly, it is a principal object of the present invention to provide a fuse suitable for operation in unusual environments and including an operation indicator.

These and other objects of the present invention are efficiently achieved by a fuse that is suitable for operation in unusual environments and includes an operation indicator that is simple and reliable. A movable arcing tube is released during operation. As the arcing tube moves outside the fuse assembly, a latching spring moves into a receiving groove in the arcing tube to retain the arcing tube in the external operated position.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
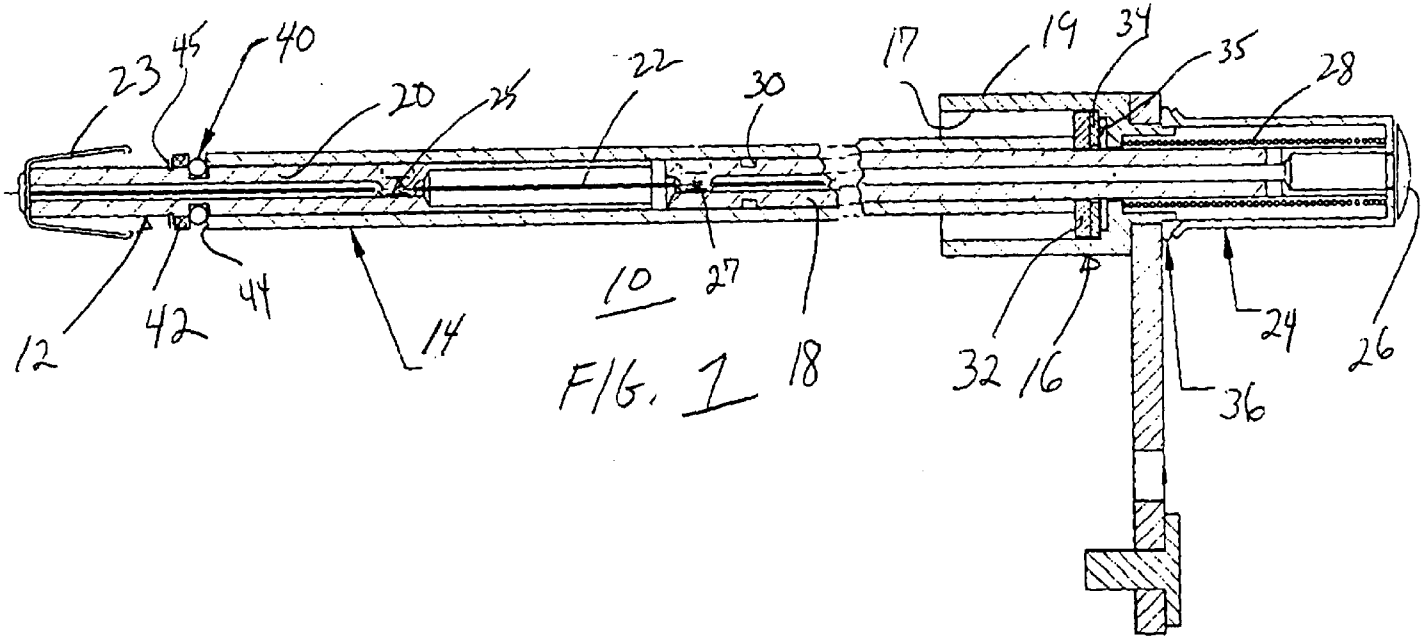
FIG. 1 is an elevational view, partly in section, of a fuse in accordance with the present invention.
Figure 2:
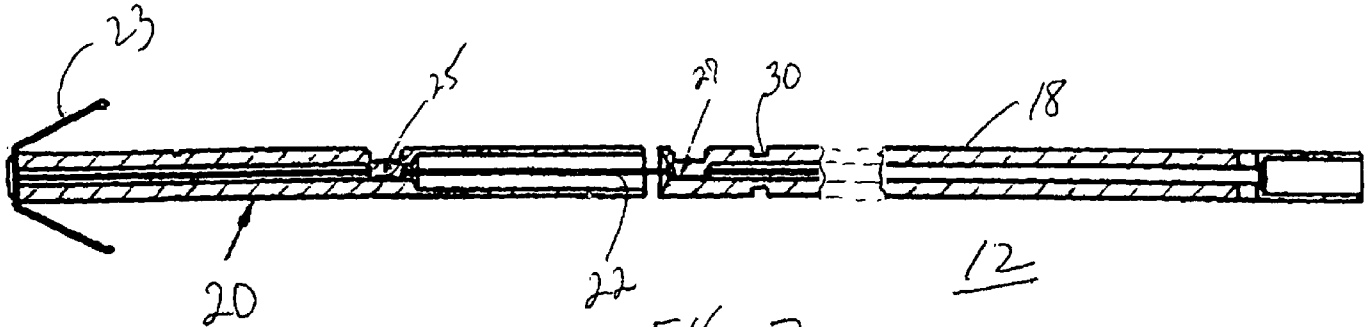
FIG. 2 is a sectional view of a fuse link assembly of the fuse of FIG. 1.
Figure 3:
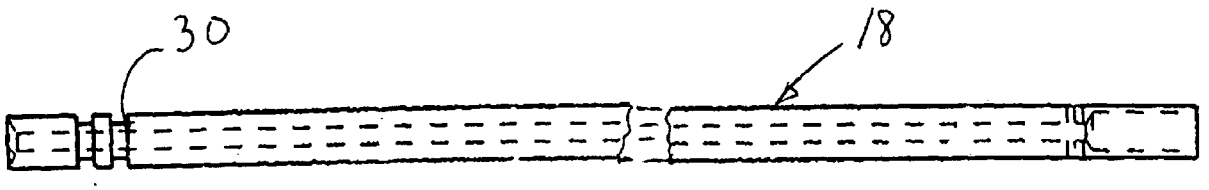
FIG. 3 is an elevational view of an arcing tube of the fuse link assembly of FIG. 2.
Figure 4:
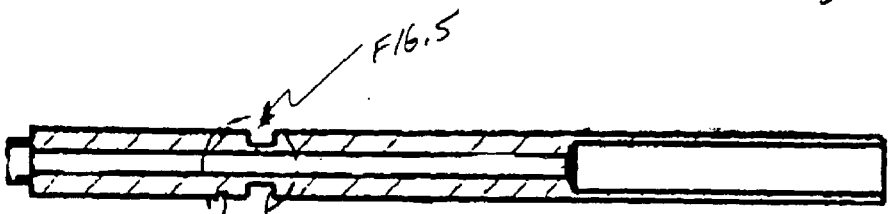
FIG. 4 is an elevational view of a lower terminal of the fuse link assembly of FIG. 2.
Figure 6:
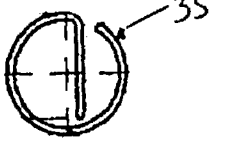
FIG. 6 is an elevational view of a latching spring member of the fuse of FIG. 1.
Figure 5:
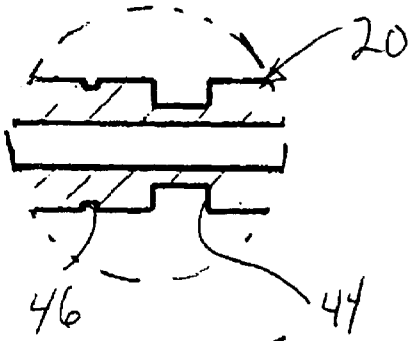
FIG. 5 is an enlarged partial view of the lower terminal of FIG. 4.

Referring now to FIGS. 1–6, a fuse 10 in accordance with the present invention includes a fuse link assembly 12 (also see FIG. 2) carried within an outer tube 14 and supported with respect to an electrode mounting assembly 16. The outer tube provides a dielectric and physical barrier to the operating environment external to the fuse link assembly 12. The electrode mounting assembly 16 provides electrical connection to an arcing tube 18 of the fuse link assembly 12 that is slidably received within the electrode mounting assembly 16. The electrode mounting assembly 16 also forms an upper terminal for connection to an electrical system. A lower terminal 20 of the fuse link assembly 12 provides electrical connection to protected equipment (not shown) via a contact 23, similar to that as shown in U.S. Pat. No. 5,502,427. A strain wire 22 provides a mechanical and electrical connection between the arcing tube or upper terminal 18 and the lower terminal 20, the strain wire 22 also functioning as a fusible element to provide the fusing characteristics of the fuse 10. The strain wire 22 is retained at a lower end to the lower terminal 20 at 25 and to the arcing tube 18 at an upper end at 27, e.g. via a swaging operation or the like. The arcing tube 18 is secured with respect to the electrode mounting assembly 16 via an upper housing element 24 and a retaining element 26 that is affixed to the upper end of the arcing tube, e.g. in a specific embodiment, the retaining element 26 is a pop rivet. In a specific embodiment, a sealing compound is applied between the upper housing element 24 and the retaining element 26. The upper housing element 24 is movable with respect to the electrode mounting assembly 16 and may also be characterized as a portion of the fuse link assembly. A spring 28 is disposed about the arcing tube 18 and within the upper housing element 24, operating against the electrode mounting assembly 16. Normally, the spring 28 is in compression. When the current between the electrode mounting assembly 16 and the lower terminal 20 and through the fuse link assembly 12 exceeds a predetermined current, the stain wire 22 becomes disintegral and the spring 28 is released thereby separating the arcing tube 18 and the lower terminal 20 of the fuse link assembly 12 and interrupting the current therethrough.

In accordance with important aspects of the present invention, the fuse 10 is includes an operation indication facility also characterized as a blown-fuse indicator. Specifically, upon operation of the fuse 10, the arcing tube 18 moves to the right in FIG. 1 with respect to the electrode mounting assembly 16 and is held in a predetermined operating position. To achieve this end, the arcing tube 18 includes a circumferential recessed portion or groove at 30 and a latching spring 35 (best seen in FIG. 6) that is positioned within a bore 17 of a cylindrical housing portion 19 of the electrode mounting assembly 16. A retaining washer 34 is also provided along with an elastomeric sealing gasket 32 intermediate the latching spring 35 and the outer end of the bore 17. Thus, when the arcing tube 18 moves to the right in FIG. 1, the latching spring 32 moves into the groove 30 whereat and whereupon the arcing tube 18 is retained providing a blown fuse indication position. The upper housing element 24 moves with the arcing tube 18 during operation. To this end, a sealing element 36 is provided intermediate the upper housing element 24 and the electrode mounting assembly 16. During normal conditions, the seal is maintained via the tension in the spring 28. The outer tube 14 is retained and sealed at the lower end with respect to the lower terminal 20 via the provision of an O-ring sealing element 40 carried within a groove 44 of the lower terminal 20 along with a support washer 42 that is retained by a snap ring 45 carried within a groove 46 of the lower terminal 20 (best seen in FIG. 5.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

What is claimed is:

1. A fuse comprising a housing and a fuse link assembly, the fuse link assembly including a movable tube that is relatively movable with respect to the housing portion during a fuse operation, the fuse further comprising indicator means for retaining the movable tube in a predetermined indicating position after fuse operation, said indicator means comprising first means carried by the housing portion and second means carried by the movable tube cooperating to retain the tube in the predetermined indicating position, said first means comprising a circumferentially biased member positioned about said movable tube, said second means comprising a receiving portion.

2. The fuse of claim 1 wherein said housing includes a housing tube and said movable tube being disposed within said housing tube.

3. The fuse of claim 2 wherein said fuse link assembly further comprises a fusible element that operates in accordance with predetermined characteristics and being arranged to retain said movable tube against movement and release said movable tube upon operation.

4. The fuse of claim 3 wherein said fuse link assembly further comprises a resilient element for storing energy to move said movable tube after operation of said fusible element.

5. The fuse of claim 4 wherein said fuse link assembly further comprises a cover in which said resilient element is disposed, said cover being relatively movable with respect to the housing.

6. The fuse of claim 5 wherein a sealing element is provided between said cover and said housing.

7. The fuse of claim 2 further comprising resilient biasing means for biasing said movable tube to move with respect to said housing, said fuse link assembly further comprising means for providing a seal between said housing tube and said fuse link assembly and for retaining said fuse link assembly against movement with respect to said housing.

* * * * *